US005148219A

United States Patent [19]

Kohyama

[11] Patent Number: 5,148,219

[45] Date of Patent: Sep. 15, 1992

[54] IMAGE FORMING APPARATUS WITH DEVELOPING AND CLEANING SYSTEM

[75] Inventor: Mitsuaki Kohyama, Higashikurume, Japan

[73] Assignee: Kabushiki Kaisha Toshiba, Kawasaki, Japan

[21] Appl. No.: 531,245

[22] Filed: May 31, 1990

[30] Foreign Application Priority Data

May 31, 1989 [JP] Japan ..... 1-138844

[51] Int. Cl.[5] ..... G03G 15/24

[52] U.S. Cl. ..... 355/219; 118/652; 355/269; 355/270

[58] Field of Search ..... 355/219, 269, 277, 270; 118/652, 661; 361/235; 346/160.1

[56] References Cited

U.S. PATENT DOCUMENTS

| | | | |
|---|---|---|---|
| 3,649,262 | 6/1987 | Hodgman et al. | 355/269 X |
| 4,311,780 | 1/1982 | Mochizuki et al. | 118/661 X |
| 4,448,872 | 5/1984 | Vandervalk | 355/277 X |
| 4,664,504 | 5/1987 | Oda et al. | 355/297 |
| 4,706,320 | 11/1987 | Swift | 355/219 X |
| 4,727,395 | 2/1988 | Oda et al. | 355/269 X |
| 4,769,676 | 9/1988 | Mukai et al. | 355/269 |

FOREIGN PATENT DOCUMENTS

| | | | |
|---|---|---|---|
| 180378 | 5/1986 | European Pat. Off. . | |
| 299502 | 1/1989 | European Pat. Off. . | |
| 3837527 | 5/1989 | Fed. Rep. of Germany . | |
| 11538 | 6/1972 | Japan . | |
| 59-133573 | 7/1984 | Japan . | |
| 62-175780 | 8/1987 | Japan . | |
| 0245277 | 10/1987 | Japan | 355/219 |
| 241587 | 10/1988 | Japan . | |
| 2129372 | 5/1984 | United Kingdom . | |

*Primary Examiner*—A. T. Grimley
*Assistant Examiner*—J. E. Barlow, Jr.
*Attorney, Agent, or Firm*—Foley & Lardner

[57] ABSTRACT

A recording apparatus including an image carrying body, an exposing device for exposing the image carrying body, to form an electrostatic latent image, a developing and cleaning device for supplying a developing agent to the electrostatic latent image, to develop the latent image, and for removing the developing agent remaining on the image carrying body, a transfer device for transferring the developed image to a sheetlike material, and a disordering and charging device for disordering the developing agent remaining on the image carrying body after transfer of the developed image, and for charging the image carrying body.

16 Claims, 2 Drawing Sheets

IMAGE FORMING APPARATUS WITH DEVELOPING AND CLEANING SYSTEM

BACKGROUND OF THE INVENTION

1. Field of the Invention

The present invention relates to a recording apparatus for developing an electrostatic latent image formed on an image carrying body, such as a photoreceptor, and recording the developed image on a transfer material such as paper.

2. Description of the Related Art

Conventional recording apparatuses of this type include electrophotographic device, electrostatic printers, etc. In the case of conventional apparatuses, an electrostatic latent image is formed on a photoreceptor, and a developing agent is then made to adhere electrostatically to the latent image, as a result of which a developing agent image is formed. Subsequently, the developing agent image is recorded by being transferred to paper. After image transfer, the electrostatic latent image and untransferred particles of the developing agent remain on the photoreceptor, the residual developing agent being removed by means of a cleaning device, and the latent image then removed by means of a de-electrifying device.

In recent times, there has been increasing demand for such recording apparatuses in more compact form. In this connection, a method is disclosed in Published Unexamined Japanese Patent Application No. 47-11538, for example, whereby a recording apparatus is reduced in size through making use of a device which serves as both a developing device and a cleaning device. According to this method, an electrostatic latent image is developed as a photoreceptor drum makes a first passage through the developing device, and a residual image remaining after transfer is cleaned off as the drum makes second passage therethrough.

However, because the cleaning step is effected by means of the photoreceptor drum making a second passage through the developing device, the recording speed is halved, and the recording area cannot be greater than the area of the whole peripheral surface of the drum. To obtain a greater recording area, therefore, the photoreceptor drum must inevitably be made relatively large in size, so that the apparatus cannot be satisfactorily reduced in size.

Disclosed in U.S. Pat. No. 3,649,262, on the other hand, is a method in which reduction of the recording speed is prevented by using a developing device which can remove the residual developing agent as it develops an electrostatic latent image.

According to this method, however, charging of the photoreceptor drum, formation of the electrostatic latent image, and developing are performed with the residual image left on the drum after the transfer process. In the charging process, therefore, the latent image and developing agent image remaining on the photoreceptor drum are unexpectedly charged, and next image exposure is effected. Accordingly, uniform charging and satisfactory formation of the electrostatic latent image cannot be ensured, and the residual image i the preceding process develops superposed on a so-called ghost image. Thus, the resulting image is not clear. Such a phenomenon is liable to present itself particularly when the solid area of the image (in which the developing agent image spreads over a wide area) overlaps the residual image in the preceding process moreover, it sometimes is the case that, a residual developing agent image, as well as the residual electrostatic latent image itself, remains as a residual image on account of insufficient cleaning, and sometimes may be transferred to the paper.

Thus, the conventional recording apparatuses cannot produce distinct images, and never permit reduction in size.

SUMMARY OF THE INVENTION

An object of the present invention is to provide a recording apparatus of reduced size and capable of producing a clear and distinct image.

According to an aspect of the present invention, there is provided a recording apparatus which comprises: an image carrying body; exposing means for exposing the image carrying body, to form an electrostatic latent image thereon; developing and cleaning means for supplying a developing agent to the electrostatic latent image, to develop the latent image, and removing developing agent remaining on the image carrying body; transfer means for transferring the developed image to a sheet like material; and disordering and charging means for disordering developing agent remaining on the image carrying body after image transfer, and charging the image carrying body.

According to another aspect of the invention, there is provided a recording apparatus which comprises an image carrying body; exposing means for exposing the image carrying body, to form an electrostatic latent image thereon; developing and cleaning means for supplying a developing agent of the same polarity as the electrostatic latent image to the latent image, to develop the latent image, and removing the developing agent remaining on the image carrying body; transfer means for transferring the developed image to a sheet like material; and disordering and charging means for disordering developing agent remaining on the image carrying body after image transfer, and charging the image carrying body.

According to still another aspect of the invention, there is provided a recording apparatus which comprises: an image carrying body; exposing means for exposing the image carrying body, to form an electrostatic latent image thereon; developing and cleaning means including an elastic developing member having a developing agent on the surface thereof and adapted to press the elastic developing member against the electrostatic latent image for sliding contact, thereby reverse-developing the latent image, and to remove developing agent remaining on the image carrying body; transfer means for transferring the developed image to a sheet like material; and disordering and charging means for disordering developing agent remaining on the image carrying body after image transfer, and charging the image carrying body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A preferred embodiment of the present invention will now be described in detail, with reference to the accompanying drawings.

Figure 1:
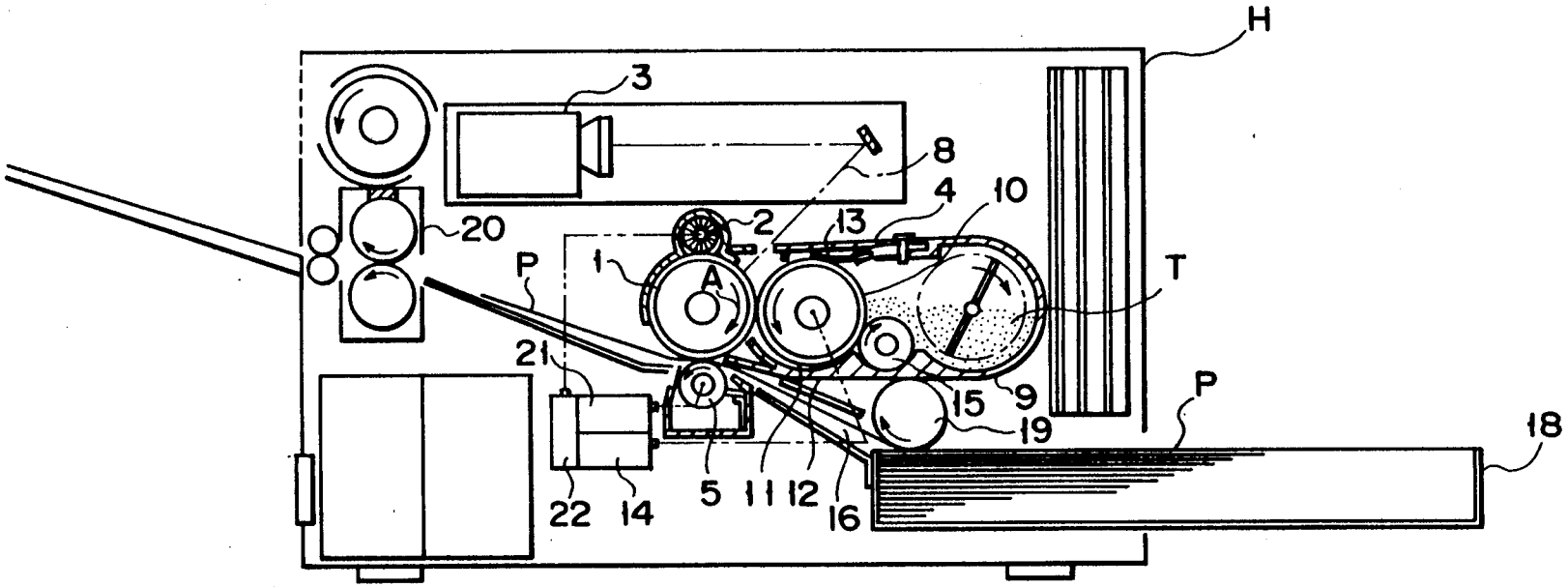
FIG. 1 is a sectional view of a recording apparatus according to an embodiment of the present invention.

FIG. 1 is a sectional view of a recording apparatus according to the preferred embodiment of the invention. As can be seen from this figure, a photoreceptor drum 1 is disposed substantially in the center of a housing H of the recording apparatus and rotatable in the direction indicated by arrow A. The photoreceptor drum 1 is formed of a photoconductive material, such as an organic photoconductor (OPC), and is surrounded by a disordering and charging device 2, a laser device 3, a developing and cleaning device 4, and a transfer roller 5.

Figure 2:
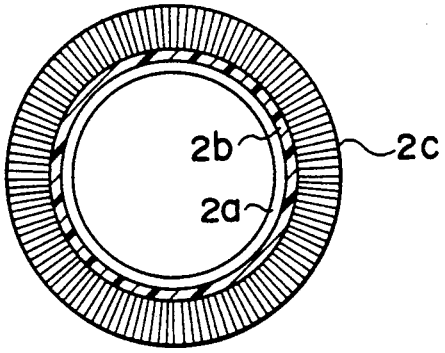
FIG. 2 is a sectional view of a disordering and charging device included in the recording apparatus shown in FIG. 1.

As shown in FIG. 2, the disordering and charging device 2 is formed by planting conductive fibers 2c of 2 to 10 mm length, 30 to 100 μm thickness, and 1,000 to 20,000/cm$^2$ density) having an electric resistance of $10^3$ to $10^9$ Ω·cm in a conductive adhesive layer 2b formed on the surface of a base tube 2a composed of paper, plastic, or metal. The conductive adhesive may be formed of a material obtained by dissolving carbon, metal powder, and epoxy resin in a solvent, such as toluene, and kneading the mixture. The disordering and charging device 2 which is situated above the photoreceptor drum 1, rotates in contact with the surface of the drum, at a peripheral speed 2 to 4 times the peripheral speed thereof. The device 2 receives a voltage of −500 to 1,500 V, and charges the surface of the drum 1 substantially uniformly to −500 to 800 V.

The laser device 3 applies a laser beam 8 to the surface of the photoreceptor drum 1, in accordance with the image to be recorded, and thus forms the desired electrostatic image.

Figure 3:
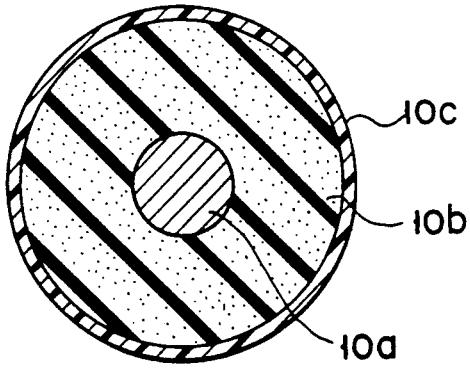
FIG. 3 is a sectional view of a developing roller included in the recording apparatus shown in FIG. 1.

The developing and cleaning device 4 is provided with a hopper 9 containing a so-called one-component developing agent T capable of being friction charged. A developing roller 10 is disposed in the hopper 9, and transports the developing agent T to the position where it faces the photoreceptor drum 1, and after image transfer, returns developing agent T remaining on the surface of the drum 1 to the hopper 9. As shown in FIG. 3, the developing roller 10 is composed of a metal shaft 10a, an elastic layer 10b surrounding the shaft 10a, and a conductive surface layer 10c formed on the surface of the layer 10b. The developing roller has elasticity as a whole. The elastic layer 10b is formed of polyurethane foam, for example, while the material constituting the conductive surface layer 10c is selected from among materials (listed later) suitable for friction charging the developing agent T and having the required elasticity and friction characteristics. The conductive surface layer 10c may be formed by applying, for example, a mixture of polyurethane resin and 10 to 30% by weight of conductive carbon to the elastic layer 10b. The electric resistance of the layer 10c ranges from $10^5$ to $10^{10}$ Ω·cm.

The developing roller 10 is pressed by an elastic blade 13 which serves to form the developing agent T as a thin layer on the surface of the roller 10. The blade 13 may be formed of phosphor bronze, polyurethane resin, or silicone resin. The developing agent T passing through the blade 13 is charged negatively or to the same polarity as the photoreceptor drum 1, thus forming one or two developing agent layers.

The developing roller 10 is connected with a bias power source 14, and is connected electrically with a surface layer 11. By virtue of this arrangement, a predetermined developing bias can be applied to the roller 10 at the time of development and cleaning. A sponge-like developing agent transportation roller 15, which is disposed in the hopper 9, serves to prevent cohesion of the developing agent T in the hopper and to transport the developing agent.

The transfer roller 5, which is situated substantially directly beneath the photoreceptor drum 1, faces the peripheral surface of the drum 1 across a paper transportation path 16. The roller 5 has the same construction as the developing roller 10, and the 10 electric resistance of its conductive surface layer 10c ranges from $10^5$ to $10^{10}$ Ω·cm. A conducting part, made of a mixture of silicone resin and 30 to 40% by weight of conductive carbon, is formed at each end portion of the transfer roller 5, and a transfer voltage to be applied to the conductive surface layer 10c passes therethrough. Thus, the transfer roller 5 applies a voltage of 800 to 1,800 V to the back surface of a sheet of transfer paper conveyed thereto, causing toner to be electrostatically attracted to the front surface of the paper, and a toner image to be transferred from the photoreceptor drum 1 to the paper. This contact-type transfer means ensures reliable image transfer even in conditions of high humidity, so that the residual developing agent can be used for the development to reduce the cleaning load. Also, paper dust from the transfer paper can be removed and prevented from getting mixed with the developing agent.

The conductive fibers 2c of the disordering and charging device 2 are in sliding contact with the photoreceptor drum 1 as the drum rotates, and are connected to a bias power source 22 so as to be supplied with a voltage of 700 to 1,500 V. Thus, the conductive fibers 2c serve to disorder the residual developing agent on the photoreceptor drum 1, to render the developing agent unreadable or nonpatterned, and de-electrify and erase the residual electrostatic latent image. At the same time, the applied voltage causes the photoreceptor drum 1 to be discharged, and the drum is charged with 500 to 800 V. This potential can be adjusted by means of the applied voltage.

Since the disordering and charging device 2 is located above the photoreceptor drum 1, the developing agent T adhering to the conductive fibers 2c can be prevented from dropping and being scattered within the apparatus. Thus, even if the developing agent T drops onto the photoreceptor drum 1, it can be transported to be recovered directly by means of the developing and cleaning device 4.

The photoreceptor drum 1 is underlain by a paper supplying unit 18 containing paper sheets P which are fed onto the paper transportation path 16 by means of a paper supplying roller 19 disposed above the paper supplying unit 18.

The transportation path 16 is provided with a fixing device 20 for fixing the toner image transferred to a given paper sheet P.

The following is a description of the operation of the recording apparatus described above.

The photoreceptor drum 1 is rotated in the direction indicated by arrow A, and the peripheral surface of the drum 1 is charged to about −500 to −800 V by means of the disordering and charging device 2. Subsequently, the laser beam from the laser device 3 is applied to the charged region, thereby forming an electrostatic latent image on the surface of the photoreceptor drum 1. Then, the drum 1 is rotated to the cleaning position where by the latent image faces the developing and cleaning device 4.

Then, developing agent (toner) T, supplied by developing roller 10 in the developing and cleaning device 4, is caused to adhere to the electrostatic latent image on the surface of the photoreceptor drum 1, the developing roller 10 being, at this time, pressed against the drum 1, so that the drum undergoes elastic deformation. As a result, the roller 10 comes into contact with the drum 1 with a predetermined nip width. In this manner, the electrostatic latent image is reverse-developed; that is, a toner image corresponding to the latent image is formed on the photoreceptor drum 1.

The toner T is charged to about −5 to −30 μ c/g by friction between the blade 13 and the developing roller 10, and a voltage of about −200 to −450 V is applied to the roller 10.

The developed toner image is then transported to a transfer region where it faces the transfer roller 5. Meanwhile, as the paper supplying roller 19 rotates, the paper sheet P is fed from the paper supplying unit 18, in synchronism with the rotation of the photoreceptor drum 1.

When the paper sheet P comes into contact with the transfer roller 5, its back surface is positively charged through a voltage of 1,000 to 2,000 V from a DC power source 21 having been applied to the transfer roller 5 via its rotating shaft, and in turn applied, via the conducting parts formed thereon to the conductive surface layer 10*c* having a resistance of $10^5$ to $10^9$ Ω·cm. As a result, the toner image on the surface of the photoreceptor drum 1 is electrostatically attracted and transferred to the sheet P. To facilitate the cleaning or the removal of adhering toner, paper dust, or other foreign matter, the surface of the transfer roller 5 should preferably be formed of a material which possesses a high degree of smoothness and low friction. In this embodiment, a conductive fluoropolymer or conductive polyester is used as the material of the conductive surface layer 10*c*, whose surface can be cleaned easily by means of a cleaning blade. The rubber hardness of the whole transfer roller 5 preferably ranges from 25 to 50, as measured according to Japanese Industrial Standards. With use of such a soft material, the allowance for the force of pressure of the transfer roller 5 on the photoreceptor drum 1 is good enough for a satisfactory result.

In this embodiment, the transfer roller is used for the image transferring operation, and a transfer efficiency of 85% or more can be obtained in a relative humidity range of 30 to 85%. In contrast, using a corona transferring method, a transfer efficiency of only 30 to 50% can be obtained under the same conditions.

After image transfer, the paper sheet P is conveyed to the fixing device, whereupon the toner is fused and fixed to the sheet P. Then, the sheet P is discharged.

After the transfer process is completed, a faint residual toner image or a positive or negative residual electrostatic latent image remains on the surface of the photoreceptor drum 1. As the drum 1 rotates, the toner image or latent image reaches the location of the disordering and charging device 2, whereupon it is rendered nonpatterned by the device 2, and the drum charged for the next process.

When the conductive fibers 2*c* on the surface of the base tube 2*a* of the disordering and charging device 2 are brought into contact with the photoreceptor drum 1, the residual electrostatic latent image and toner image are disordered and rendered unreadable by means of mechanical and electrostatic forces. At the same time, 5 a voltage is applied to the base tube 2*a* to cause discharge, thereby charging the photoreceptor drum 1. As a result, the disordered residual toner image is scattered on the surface of the drum 1 and adheres lightly thereto without being brushed off by the conductive fibers 2*c* (the disordering and charging device 2 does not primarily serve as a cleaning device, but performs cleaning only an as auxiliary function). The toner particles scattered thus on the surface of the photoreceptor drum 1 are distributed in clusters too small to form either characters or an image.

The disordered and charged photoreceptor drum 1 is exposed by means of the laser device 3 to form an electrostatic latent image thereon, and is then reaches again the developing and cleaning position where it faces the developing and cleaning device 4.

In the electrostatic latent image, the residual toner is spread uniformly and thin enough both in an exposed portion, to which the toner is expected to adhere, and in a non-exposed portion, so that there is no possibility of irregular exposure. Thus, the residual potential after exposure is uniform, so that a uniform toner image can be obtained even in a second cycle of development.

As described above, the developing roller 10 has a hardness of 30 to 70 (based on the JIS rubber hardness measurement method) and a low resistance of $10^2$ to $10^8$ Ω·cm. If a linear load of 20 to 150 g/cm is applied to the developing roller 10, and if the roller 10 is brought into sliding contact with the photoreceptor drum 1 at a peripheral speed 1.5 to 4 times as high as the peripheral speed of the drum 1, a contact width (nip width) of 1 to 4 mm is formed. When the residual toner and the toner T on the developing roller 10 are in sliding contact at the nip portion, a great frictional force is produced between them, whereby the cleaning capacity can be increased. If the developing agent is formed of the toner T only, reduction of image quality, such as streaks, cannot be caused.

In the non-exposed portion, moreover, the force of attraction by the developing bias is greater than that of the photoreceptor drum 1, so that the toner T adhering to the drum 1 is attracted to the developing and cleaning device 4 and recovered. Thus, new toner particles from the developing roller 10 are caused to adhere to the exposed portion by supplying the roller 10 with the developing bias of a proper value intermediate between the residual potential of the exposed portion and the potential of the non-exposed portion. At the same time, the residual toner on the non-exposed portion is attracted to the developing roller 10 and recovered. In this case, the residual toner is only small quantity, and is scattered in small dots by the disordering and charging device 2, so that it can be efficiently recovered by means of the disordering and charging device 2. Thus, one toner image can be obtained by repeatedly rotating the photoreceptor drum 1. After the developing and cleaning, the toner image is transferred to the paper sheet P at the position where it faces the transfer roller 5. Thereafter, the same processes of operation are repeated.

According to the recording apparatus of the embodiment described above, the memory image, which has conventionally been produced, can be eliminated, and defective cleaning can be prevented, despite the use of the photoreceptor drum 1 with a short diameter. When 20,000 copies were taken using an image area of about 7% and size-A4 paper sheets, they all were able to provide satisfactory images without entailing defective cleaning.

By suitably adjusting the bias voltage applied to the disordering and charging device 2, moreover, the potential of the charged surface of the photoreceptor drum 1 can be properly adjusted, the toner can be effectively disordered, and the recovery of the toner can be positively prevented. Thus, the toner can be prevented from accumulating in the device 2. In this case, the toner adhering to the disordering and charging device 2 can be forced out onto the surface of the photoreceptor drum 1 by applying a voltage of, for example, about 100 to 300 V to the device 2 during non-printing operation, that is, while the non-image region is passing the device 2. The discharged toner is transported to the developing and cleaning device 4 to be recovered thereby.

Figure 4:
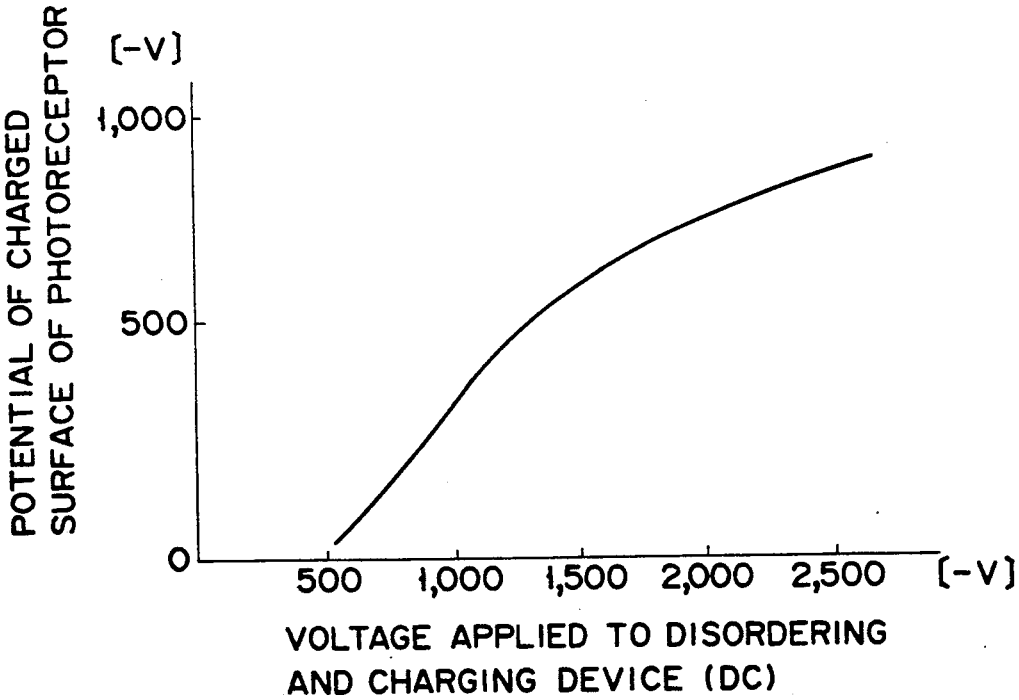
FIG. 4 is a graph showing the relationship between the voltage applied to the disordering and charging device shown in FIG. 2 and the potential of the charged surface of a photoreceptor.

FIG. 4 is a graph showing the way the potential of the charged surface of the photoreceptor drum 1 changes when a DC voltage is applied to the disordering and charging device 2. In measurement, no toner exists on the surface of the photoreceptor drum 1, and the disordering and charging device 2 is rotated in the direction opposite to the rotating direction of the drum 1. The peripheral speed of the drum 1 is 65 mm/sec, while that of the device 2 is 130 mm/sec. The electric resistance of the conductive fibers 2c used is $10^9$ Ω·cm (manufacturer's nominal value).

If a voltage of about −1,500 V is applied to the disordering and charging device 2, the potential of the charged surface of the photoreceptor drum 1 is within a desired range from −600 to −700 V, as seen from FIG. 4. Even if any of the toner remains on the drum 1 after the transfer, the charged surface potential of the drum 1 is substantially within the desired range.

The toner can be prevented from accumulating in the disordering and charging device 2 by an alternative method. According to this method, a charging region for attracting the toner adhering to the device 2 is formed in the non-image region on the photoreceptor drum 1. In this case, the drum 1 is charged to the polarity opposite to that of the electrostatic latent image by means of the transfer roller 5. This can be easily done in a reverse development system.

Although the transfer roller 5 is used as the contact-type transfer means in the device according to the embodiment described above, it may be replaced by a transfer belt. In the above embodiment, moreover, the conductive elastic roller is used as the transfer roller 5. Alternatively, however, an insulating elastic roller or a corona transfer means including a belt may be used for the purpose.

In the device according to the embodiment described above, furthermore, the nonmagnetic one-component developing system is used as an example which best facilitates the reduction in size. However, the present invention is not limited to this embodiment, and the magnetic one-component brush method, fur brush method, cascade method, etc. may be also employed.

As described above, the recording apparatus according to the present invention is provided with the disordering and charging means which serves to disorder the developing agent remaining on the image carrying body, thereby rendering the developing agent nonpatterned, and charge the image carrying body. Thus, irregular exposure and production of the memory image can be prevented, so that a distinct image can be obtained. Moreover, the cleaning efficiency for the residual developing agent can be improved, and the apparatus, which need not be provided with an exclusive-use charging device, can be reduced in size.

Further, the reverse development is used, and the image carrying body and the developing agent are charged to the same polarity, so that the cleaning efficiency for the residual developing agent on the image carrying body can be improved. Furthermore, the elastic developing member is pressed against the electrostatic latent image o the image carrying body for sliding contact. Thus, a great frictional force can be produced between the elastic developing member and the developing agent to improve the cleaning efficiency.

Additional advantages and modifications will readily occur to those skilled in the art. Therefore, the invention in its broader aspects is not limited to the specific details, representative devices, and illustrated examples shown and described herein. Accordingly, various modifications may by without departing from the spirit or scope of the general inventive concept as defined by the appended claims and their equivalents.

What is claimed is:

1. An image forming apparatus comprising:

means for forming a latent image on an image carrying body;

means, constituted within a single unit, for developing the latent image with a developing agent, and for simultaneously removing the developing agent remaining on the image carrying body while the latent image is developed;

means for transferring the developed image from the image carrying body to a sheet-like material; and disordering and charging means for disordering the developing agent remaining on the image carrying body after transfer of the developed image by the transfer means, so as to render the developing image unreadable or nonpatterned, and for charging the image carrying body at a predetermined potential while the developing agent remaining on the image carrying body is disordered, said disordering and charging means consisting essentially of a single brush positioned for contact with said image carrying body.

2. The recording apparatus according to claim 1, wherein said conductive brush includes a base tube, a conductive adhesive layer formed on the surface of the base tube, and conductive fibers planted in the conductive adhesive layer.

3. The recording apparatus according to claim 1, wherein said disordering and charging means is located above the image carrying body.

4. The recording apparatus according to claim 1, wherein said image carrying body includes an organic photoconductor.

5. The recording apparatus according to claim 1, wherein said developing and cleaning means includes a developing roller in sliding contact with the image carrying body and an elastic blade in sliding contact with the developing roller.

6. The recording apparatus according to claim 1, wherein said transfer means includes a transfer roller.

7. A recording apparatus comprising:

an image carrying body;

means for forming an electrostatic latent image on the image carrying body;

developing and cleaning means, constituted within a single unit, for supplying a developing agent of the same polarity as the electrostatic latent image to the latent image to develop the latent image and for simultaneously removing developing agent remaining on the image carrying body;

means for transferring the developed image to a sheet-like material; and a device consisting essentially of a single means for simultaneously performing both disordering the developing agent remaining on the image carrying body after transfer of the developed image by the transfer means, and charging the image carrying body for forming a latent image.

8. The recording apparatus according to claim 7, wherein said single means includes a conductive brush.

9. The recording apparatus according to claim 8, wherein said conductive brush includes a base tube, a conductive adhesive layer formed on the surface of the base tube, and conductive fibers planted in the conductive adhesive layer.

10. The recording apparatus according to claim 7, wherein said single means is located above the image carrying body.

11. A recording apparatus comprising:

an image carrying body;

means for forming an electrostatic latent image on the image carrying body;

developing and cleaning means, constituted within a single unit, and including an elastic developing member having a developing agent on the surface thereof and adapted to press the elastic developing member against the electrostatic latent image for sliding contact, for reverse-developing the latent image, and for simultaneously removing developing agent remaining on the image carrying body;

means for transferring the developed image by the developing and cleaning means to a sheet-like material; and a device consisting essentially of a single means for simultaneously both disordering the developing agent remaining on the image carrying body after transfer of the developed image by the transfer means and charging the image carrying body for forming a latent image.

12. The recording apparatus according to claim 11, wherein said single means includes a conductive brush.

13. The recording apparatus according to claim 12, wherein said conductive brush includes a base tube, a conductive adhesive layer formed on the surface of the base tube, and conductive fibers planted in the conductive adhesive layer.

14. The recording apparatus according to claim 11, wherein said single means is located above the image carrying body.

15. The recording apparatus according to claim 11, wherein said single means further includes an elastic blade in sliding contact with the elastic developing member.

16. An image forming apparatus comprising:

means for forming a latent image on an image carrying body;

a single roller constituting a developing and removing roller, positioned for sliding contact with the image carrying body, for developing the latent image formed on the image carrying body with a one-component developing agent and for simultaneously removing the developing agent remaining on the image carrying body while the latent image is being developed;

means for transferring the developed image from the image carrying body to a sheet-like material; and a single brush constituting a disordering and charging brush, positioned for sliding contact with the image carrying body, for disordering the developing agent remaining on the image carrying body after transfer of the developed image by the transfer means, so as to render the developing image unreadable or nonpatterned, and for simultaneously charging the image carrying body at a predetermined potential while the developing agent remaining on the image carrying body is disordered.

* * * * *